United States Patent [19]

Roux

[11] 4,296,692

[45] Oct. 27, 1981

[54] RAILWAY CAR CEILING PANEL

[75] Inventor: Marc Roux, La Rochelle, France

[73] Assignee: Alsthom-Atlantique, Paris, France

[21] Appl. No.: 73,037

[22] Filed: Sep. 6, 1979

[30] Foreign Application Priority Data

Sep. 13, 1978 [FR] France ..... 78 26247

[51] Int. Cl.[3] ..... B60R 13/08; B61D 17/18; E04B 13/08

[52] U.S. Cl. ..... 105/397; 52/17; 52/145; 105/401; 105/423; 296/211; 296/214

[58] Field of Search ..... 52/17, 20, 145, 78 D; 105/396, 397, 401, 423; 296/211, 214

[56] References Cited

U.S. PATENT DOCUMENTS 2,823,951 2/1958 Stahl ..... 296/214

2,925,050 2/1960 Candlin, Jr. et al. ..... 105/397

3,379,469 4/1968 Elia ..... 296/211

3,651,887 3/1972 Eckel ..... 52/145 X

*Primary Examiner*—Joseph F. Peters, Jr.

*Assistant Examiner*—Howard Beltran

*Attorney, Agent, or Firm*—Sughrue, Mion, Zinn, Macpeak and Seas

[57] ABSTRACT

The invention relates to a ceiling component which is formed by a curved panel and has a support which supports a layer of sound-proofing and heat insulating material. The support is made in one piece and is constituted by a metal sheet whose edges are bent back on itself and then to form a flange projecting from one surface of said panel. The bent edges alone provide the rigidity necessary for the panel without requiring the use of ribs and girders.

4 Claims, 5 Drawing Figures

RAILWAY CAR CEILING PANEL

The present invention relates to ceiling components for vehicles and the like and more particularly to ceiling components for rail vehicles, said ceiling components meeting certain sound-proofing and/or heat-proofing requirements and being light and having a pleasing appearance.

The type of ceiling component to which the invention applies is that in the form of a curved panel which acts as a support for supporting a thickness of insulating material.

BACKGROUND

The usual design of such components provides a support formed by straight ribs and girders bent to the curve required for the ceiling component and fastened transversally to said ribs. In particular, such components for rail vehicles are very often made with two ribs which form the longitudinal straight edges and eight curved transversal girders, the support thus constituted being covered with layers of insulating material; a perforated metal sheet is applied against the rigid support thus formed and a protective fabric is sandwiched between the metal sheet and the support.

Such a design has numerous drawbacks: the support formed by the ribs and the pre-curved girders is heavy and requires several connection operations; also, it is difficult to match the perforated metal sheet with the ribs and girders and it is very tricky to sandwich the intermediate fabric: the assembly operations as a whole require skilful labour and this appreciably increases the cost of the final component.

The invention aims to provide a ceiling component of simpler design which is easy to assemble, light and economical, while meeting the conventional structure requirements for such components.

THE INVENTION

The invention provides, more particularly, a ceiling component, in particular for rail vehicles, said component being formed by a curved panel and having a support which supports a thickness of sound-proofing and/or heat insulating material. The invention is characterized in that the support is made in one piece and is constituted by a metal sheet whose edges are bent so as to form a flange projecting from one surface of said panel, said bent edges alone providing the rigidity necessary for the panel without requiring the use of ribs and/or girders.

The ceiling component according to the invention preferably has at least one of the following characteristics:

Each edge is bent twice, firstly completely inwards and secondly in a plane which is substantially perpendicular to the first bend and which alone forms the peripheral flange.

It also includes a cloth of the type made of synthetic fibre fabric and whose dimension corresponds substantially to that of said component and which is held by gripping its edges by means of the completely inwardly bent portion.

The peripheral flange allows a layer of sound-proofing and/or heat insulating material to be fitted thereto, the layer being held at least by fixing means connected only to the edges of said flange.

The metal sheet is perforated and is made of a light material such as an aluminium alloy.

DRAWINGS

Other advantages and characteristics of the invention will become more clearly apparent from the following description, given by way of illustration but having no limiting character, with reference to the accompanying drawings.

DESCRIPTION OF THE PREFERRED EMBODIMENT

Figure 1:
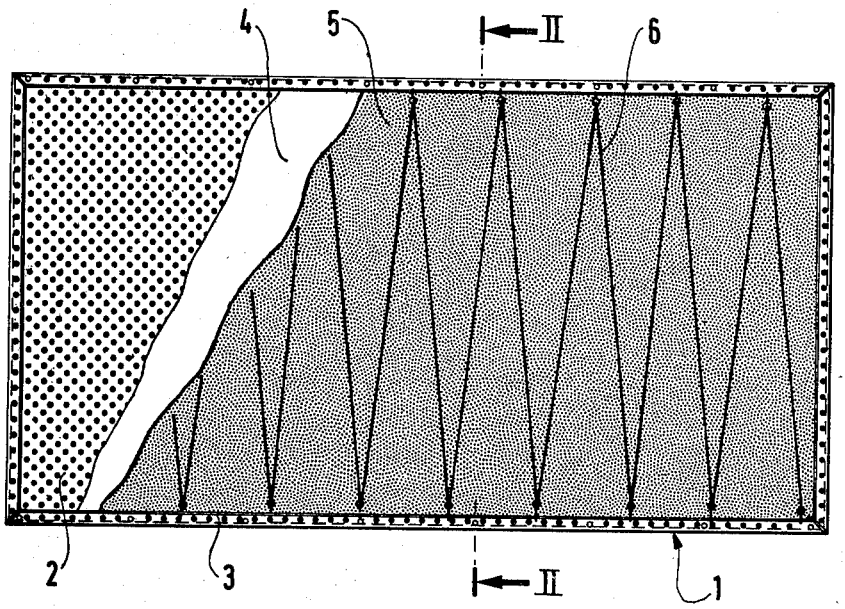
FIG. 1 is a partially cut away plan view of a ceiling component in accordance with the invention and seen from above.

FIG. 1 is a top view of the convex surface of a ceiling component 1 in accordance with the invention, said component having the shape of a curved panel and a support which bears a thickness of sound-proofing and/or heat insulating material. In accordance with the invention, the support is a one-piece component constituted by a metal sheet 2 whose edges are bent back so as to form a peripheral flange on one surface (in the present case, the convex surface) of the panel, the bent edge alone providing the rigidity necessary for said panel without requiring the use of girders and/or ribs. Advantageously, each edge is bent twice, firstly completely inwards and, secondly, along a plane substantially perpendicular to the ceiling component which alone forms the flange 3. The fundamental double bending is more apparent from the detailed FIGS. 3, 4 and 5.

The simplicity of the design of such a ceiling component is immediately apparent: instead of connecting together two ribs, eight girders and a metal sheet, a single metal sheet is simply bent twice and curved to the required extent; therefore, a single metal sheet replaces all the components of former types of panel. Further, double bending also allows easy assembling of various conventional sound-proofing and/or heat insulating and/or protecting materials: for example, a very strong synthetic fibre cloth 4 through which air passes freely to provide proper ventilation, the dimensions of the cloth corresponding substantially to that of the panel, is held by gripping its edges by bending the edges of said panel completely inwards and a layer 5 made of sound-proofing and/or heat insulating material such as glass wool is placed in the space defined by the flange 3 and held by anchoring means such as tie lines 6 connected only to the edges of said flange. The metal sheet 2 is advantageously pierced and made of a light substance such as an aluminium alloy which provides such lightness as well as sound-proofing and pleasing appearance (the metal sheet will preferably be previously lacquered); the perforated metal sheet 4 is conventionally designed to prevent the insulation fibres passing through the holes of the metal sheet 2 when the heat-proofing layer is added.

Figure 2:
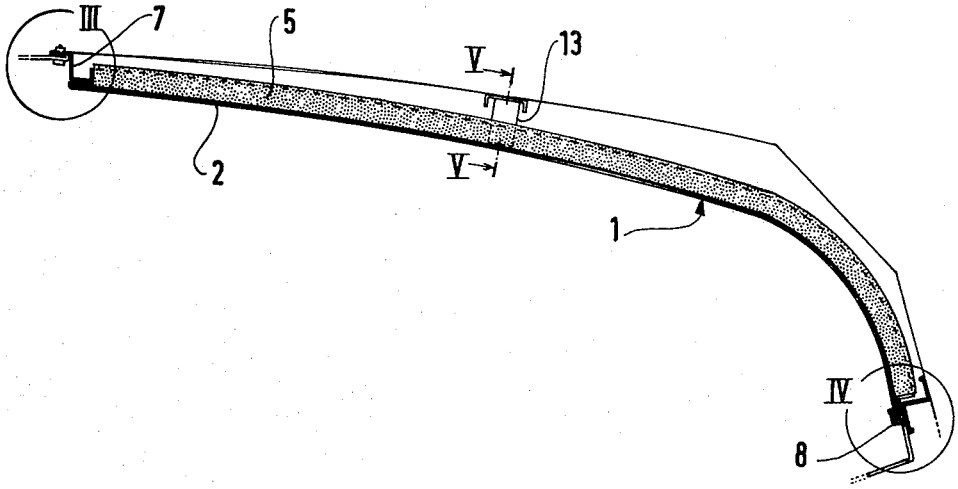
FIG. 2 is a cross-section through line II-II of the ceiling component illustrated in FIG. 1, assembled in a railway vehicle.

FIG. 2 illustrates the ceiling component installed in a rail vehicle, said component being fixed at its longitudinal edges by body fixing parts 7, 8 which are described in detail hereinbelow.

Figure 3:
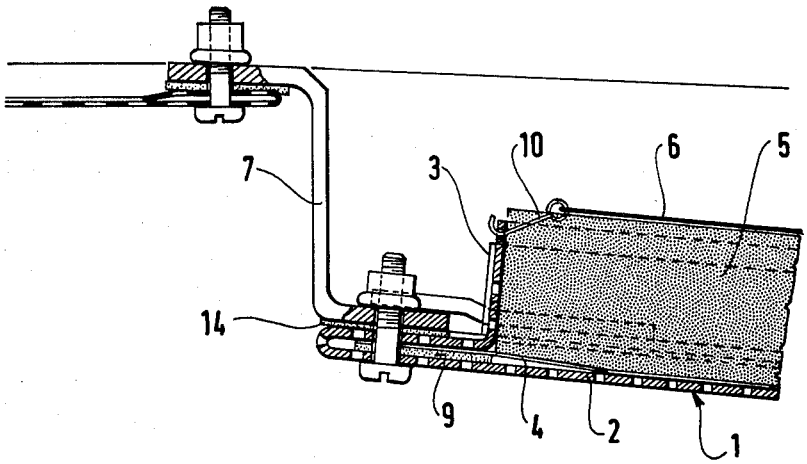
FIGS. 3 and 4 are sectional views which illustrate respectively enlarged details at III and IV of FIG. 2.
Figure 4:
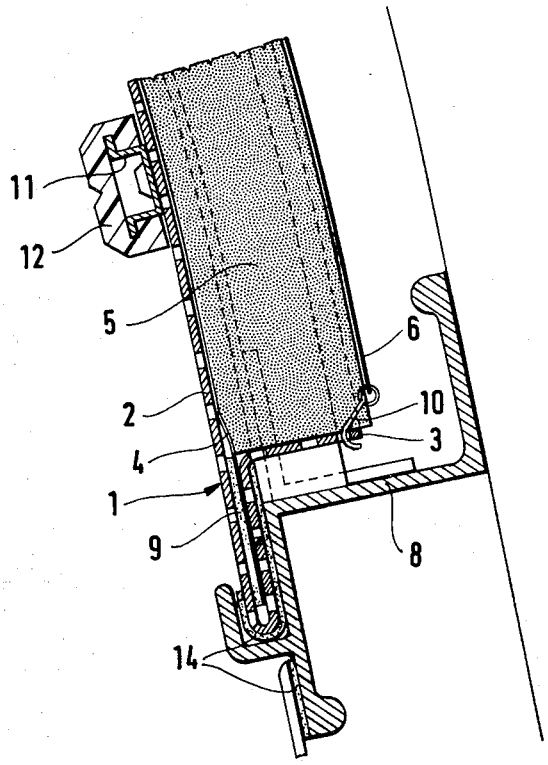

FIGS. 3 and 4 are on an enlarged scale which makes it easier to illustrate the double bending of the metal sheet 2.

A ceiling component in accordance with the invention is obtained by carrying out the following steps:

the edges of the metal sheet 2 are bent a first time to define a rim which is substantially perpendicular to the plane of said metal sheet, advantageously, adhesive tapes 9 are laid on both their surfaces and the cloth 4 is positioned against the metal sheet, said cloth then being provisionally held by said tapes, the edges are bent a second time inwardly and through 180°; this has the effect of defining the flattened outer edges of the panel and a peripheral flange 3 perpendicular to the ceiling component and also of crimping the edges of the cloth 4 by simple pinching, the panel is bent until it is sufficiently curved on a die and stamp assembly which is advantageously made of wood; the concave component of said assembly has two grooves in which engage the two corresponding flanges, said flanges being deformed in their planes until the desired curve is obtained, and the layer 5 (which is often in several portions) is held and fixed by tie lines 6 fixed by hooks 10 installed as required in holes in the metal sheet 2. In general the holes in question are near the edge of the flange 3.

Fixing plates 11 can be fixed on the concave surfaces of the panels to fix very long battens 12 which improve the appearance and pass across several ceiling components.

Figure 5:
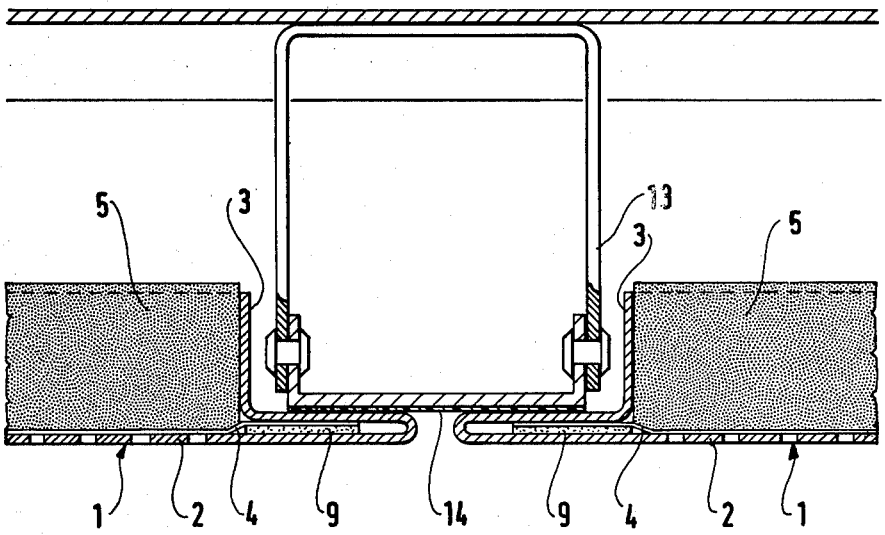
FIG. 5 is a cross-section along line V-V of FIG. 2, showing the edges of two adjacent components.

It may be useful to provide an intermediate part 13 (see FIG. 5) against which the edges of two adjacent panels press. Further, resilient damping shoes 14 prevent any noisy or vibrating contact on the connection parts 7 and 8 (FIGS. 3 and 4) and on the intermediate bearing part 13 (FIG. 5).

Naturally, a wide range of methods for fixing the ceiling component can be provided and the person skilled in the art will choose any structure well-adapted to the problem for the connection parts 7, 8: here, a solid part 8 has been chosen which has a U-shaped support portion for the lower portion of the panel (FIG. 4) and a bracket 7 for bolting the upper portion of said panel (FIG. 3). This variant is economical and makes assembling easy since it is necessary only to tilt the panel about its embedded lower edge to bolt its upper part; of course, the part 8 illustrated can be replaced by a bracket which can also bolt the lower portion of the panel, or by any other equivalent fixing means.

As is apparent from the description, the ceiling component in accordance with the invention has numerous advantages: its design is greatly simplified by reducing the number of component parts, assembling is easy due to the lightness of the panel without reducing the rigidity of said panel, said rigidity being suitable and the panel not resonating due to any vibrations and naturally the cost of such a component is therefore low with respect to panels of previous design.

It is self-evident that the present invention is in no way limited to the examples which have been given thereof by way of illustration, but includes any variant which, with equivalent means, resumes the essential characteristics of the invention such as claimed.

I claim:

1. A ceiling component, in particular for rail vehicles, said component being formed by a curved panel and having a support which supports a layer of soundproofing and heat insulating material, the improvement wherein the support is made in one piece and is constituted by a metal sheet having double edge portions forming a peripheral flange spaced slightly inwardly projecting from one surface of said panel, said double edge portions alone providing the rigidity necessary for the panel and wherein each edge portion is bent twice, firstly completely inwards on itself and, secondly, in a plane which is substantially perpendicular to the first bend and which alone forms the peripheral flange.

2. A component according to claim 1, wherein the metal sheet is perforated and is made of a light-weight metal.

3. A component according to claim 1, further including a cloth of the type made of synthetic fibre fabric and whose planar dimension corresponds substantially to that of said component and which is held by gripping its edges by means of the double edge portions of said metal sheet.

4. A component according to claim 1 or claim 3, wherein the peripheral flange fits said layer of soundproofing and heat insulating material thereto, said layer being held by fixing means connected only to said flange edges.

* * * * *